US009211985B2

(12) United States Patent
Milani

(10) Patent No.: US 9,211,985 B2
(45) Date of Patent: Dec. 15, 2015

(54) ADJUSTABLE STRAP

(71) Applicant: Charles Joseph Milani, San Jose, CA (US)

(72) Inventor: Charles Joseph Milani, San Jose, CA (US)

(73) Assignee: Charles Joseph Milani, San Jose, CA (US)

( * ) Notice: Subject to any disclaimer, the term of this patent is extended or adjusted under 35 U.S.C. 154(b) by 272 days.

(21) Appl. No.: 13/725,632

(22) Filed: Dec. 21, 2012

(65) Prior Publication Data

US 2014/0173855 A1 Jun. 26, 2014

(51) Int. Cl.
*B65D 63/10* (2006.01)
*B65D 63/14* (2006.01)
*B65D 63/16* (2006.01)

(52) U.S. Cl.
CPC ..... *B65D 63/10* (2013.01); *B65D 63/1018* (2013.01); *B65D 63/14* (2013.01); *B65D 63/16* (2013.01); *Y10T 24/1406* (2015.01)

(58) Field of Classification Search
CPC ... B60P 7/0823; B60P 7/0838; B65D 63/109; B65D 63/16; Y10T 24/2121; Y10T 24/2117; Y10T 24/2164; Y10T 24/2175; Y10T 24/4736; Y10T 24/4773
See application file for complete search history.

(56) References Cited

U.S. PATENT DOCUMENTS

| | | | |
|---|---|---|---|
| 2,372,967 | A | 4/1945 | Martin |
| 2,705,461 | A | 4/1955 | Campbell |
| 3,106,028 | A | 10/1963 | Baumgartner |
| 3,149,808 | A | 9/1964 | Weckesser |
| 3,257,694 | A | 6/1966 | Litwin |
| 3,302,913 | A | 2/1967 | Collyer et al. |
| 3,416,762 | A | 12/1968 | Headrick |
| 3,510,142 | A | 5/1970 | Erke |
| 3,556,575 | A | 1/1971 | Farkas |
| 3,597,803 | A | 8/1971 | Van Neil |
| 3,654,669 | A | 4/1972 | Fulton |
| 3,731,347 | A | 5/1973 | Caveney et al. |
| 3,747,164 | A | 7/1973 | Fortsch |
| 3,835,505 | A | 9/1974 | Shewbridge |
| 3,908,233 | A | 9/1975 | Caveney et al. |
| 3,994,048 | A | 11/1976 | Rosentthal |
| D255,782 | S | 7/1980 | Forest |
| 4,272,900 | A | 6/1981 | MacLarty et al. |

(Continued)

FOREIGN PATENT DOCUMENTS

| | | | |
|---|---|---|---|
| DE | 19622087 | A | 5/1996 |
| GB | 2243401 | A | 10/1991 |

(Continued)

OTHER PUBLICATIONS

U.S. Appl. No. 60/386,825, filed Jun. 2002, Pangallo.

*Primary Examiner* — Jack W Lavinder
(74) *Attorney, Agent, or Firm* — Alston & Bird LLP

(57) ABSTRACT

An adjustable strap assembly comprises a cincture and a band. The cincture and the band preferably include attachment components on end and are adjustably connected such that the overall length of the strap assembly can vary in length from as little as approximately just the length of the cincture to as long as approximately the length of the cincture and band together. In addition the embodiments may include a securing mechanism to maintain the adjustable strap assembly at the desired length even under stress. In one embodiment the band is made from elastic material to ensure that when the adjustable strap assembly is used to cinch a bundle, the adjustable strap assembly will remain tight.

22 Claims, 6 Drawing Sheets

(56) References Cited

U.S. PATENT DOCUMENTS

| | | | | |
|---|---|---|---|---|
| 4,497,259 | A | | 2/1985 | Titterton |
| 4,534,596 | A | | 8/1985 | Bonerb |
| 4,688,302 | A | | 8/1987 | Caveney et al. |
| 4,875,596 | A | | 10/1989 | Lohse |
| 4,878,274 | A | | 11/1989 | Patricy |
| 4,911,317 | A | | 3/1990 | Schloesser et al. |
| 4,982,885 | A | | 1/1991 | Severson et al. |
| 4,991,265 | A | | 2/1991 | Campbell et al. |
| 5,046,945 | A | | 9/1991 | McGowan |
| 5,075,933 | A | | 12/1991 | Kemper |
| D326,406 | S | | 5/1992 | Anderson |
| 5,167,050 | A | | 12/1992 | Korsen |
| 5,168,603 | A | | 12/1992 | Reed |
| 5,188,460 | A | | 2/1993 | Dorre |
| 5,214,874 | A | | 6/1993 | Faulkner |
| 5,395,343 | A | | 3/1995 | Iscovich |
| 5,402,732 | A | | 4/1995 | Erickson et al. |
| 5,437,384 | A | | 8/1995 | Farrell |
| 5,457,853 | A | | 10/1995 | Klein |
| 5,524,945 | A | | 6/1996 | Georgopoulos et al. |
| 5,582,337 | A | | 12/1996 | McPherson et al. |
| 5,603,591 | A | | 2/1997 | McLellan |
| 5,623,750 | A | * | 4/1997 | Nasin et al. ..... 24/68 CD |
| 5,758,390 | A | | 6/1998 | Villeneuve |
| 5,824,995 | A | | 10/1998 | Wise |
| 5,924,171 | A | | 7/1999 | Sorensen |
| 6,003,208 | A | | 12/1999 | Christian et al. |
| 6,105,210 | A | | 8/2000 | Benoit |
| 6,151,761 | A | | 11/2000 | Thompson |
| 6,185,792 | B1 | | 2/2001 | Nelson et al. |
| 6,186,451 | B1 | | 2/2001 | Benoit |

FOREIGN PATENT DOCUMENTS

| | | | |
|---|---|---|---|
| GB | 2352477 | A | 1/2001 |
| NL | 1004356 | C1 | 4/1998 |

* cited by examiner

ADJUSTABLE STRAP

TECHNICAL FIELD

The example embodiments of the present invention generally pertain to straps, and more particularly to adjustable straps.

BACKGROUND

Straps, such as a cinching strap, are frequently used to secure bundled and coiled objects together. While cinching straps presently exist to secure bundled or coiled objects, these straps are frequently "one size fits all." With the one size fits all strap, the strap is always just a little too big. As a result there will always be excess strap ends to deal with. In some straps the loose end gets rolled around a wheel as the strap is ratcheted tight, which takes time to roll when cinching the strap and takes time to unroll when releasing. Other systems simply leave it to the user to figure out what to do with the excess straps. What is needed is an adjustable strap assembly that allows the user to quickly and easily set the length of the strap to fit the desired bundle to be cinched while eliminating the excess strap ends.

BRIEF SUMMARY

According to one exemplary embodiment of the present invention, an adjustable strap assembly comprises a cincture and a band. The cincture and the band preferably include attachment components on end and are adjustably connected such that the overall length of the strap assembly can vary in length from as little as approximately just the length of the cincture to as long as approximately the length of the cincture and band together. In addition the embodiments may include a securing mechanism to maintain the adjustable strap assembly at the desired length even under stress. In one embodiment the band is made from elastic material to ensure that when the adjustable strap assembly is used to cinch a bundle, the adjustable strap assembly will remain tight.

BRIEF DESCRIPTION OF THE DRAWING(S)

Having thus described the example embodiments of the present invention in general terms, reference will now be made to the accompanying drawings, which are not necessarily drawn to scale, and wherein:

DETAILED DESCRIPTION

The various embodiments are described more fully with reference to the accompanying drawings. These example embodiments are provided so that this disclosure will be thorough and complete, and will fully convey the scope of the invention to readers of this specification having knowledge in the technical field. In this regard, references may be made herein to directions and orientations including left, right, inward, outward, upward, downward, behind and/or in front of; it should be understood, however, that any direction and orientation references are simply examples and that any particular direction or orientation may depend on the particular object, and/or the orientation of the particular object, with which the direction or orientation reference is made. Like numbers refer to like elements throughout.

Figure 1:
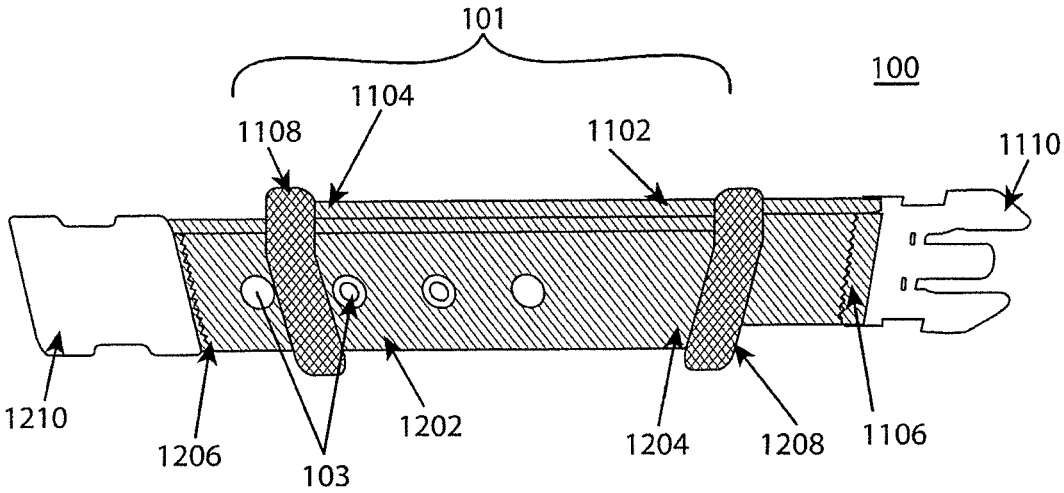
FIG. 1 illustrates a schematic view of an adjustable strap assembly in accordance with an exemplary embodiment.
Figure 2:
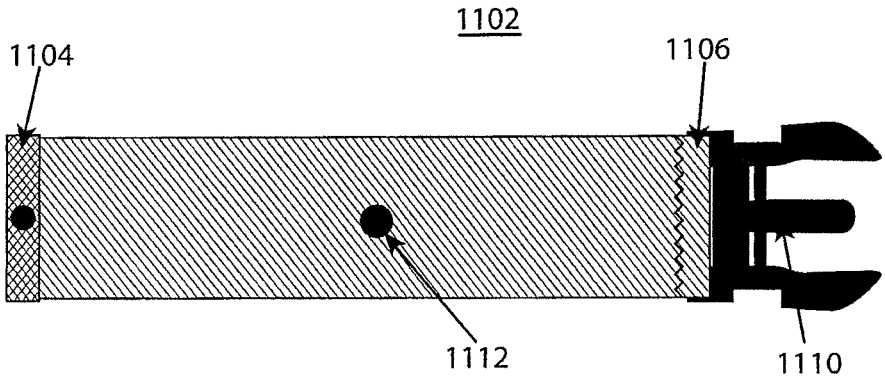
FIG. 2 illustrates a front view of a cincture of the adjustable strap assembly illustrated in FIG. 1 in accordance with an exemplary embodiment.
Figure 3:
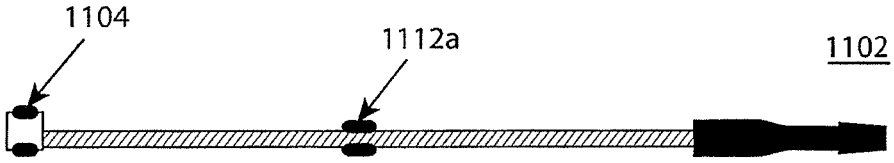
FIG. 3 illustrates a side view of the cincture of the adjustable strap assembly illustrated in FIG. 2 in accordance with an exemplary embodiment.
Figure 4:
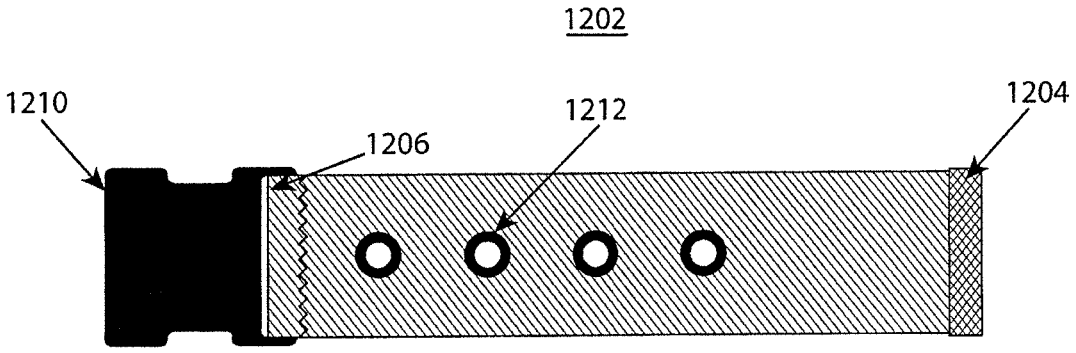
FIG. 4 illustrates a front view of a band of the adjustable strap assembly illustrated in FIG. 1 in accordance with an example embodiment.
Figure 5:
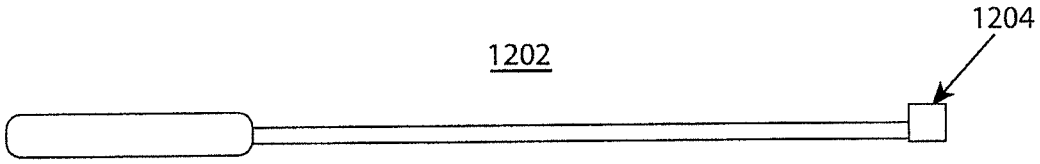
FIG. 5 illustrates a side view of the band of the adjustable strap assembly illustrated in FIG. 4 in accordance with an exemplary embodiment.

FIG. 1 illustrates a schematic view of an adjustable strap assembly 100 in accordance with an exemplary embodiment of aspects of the invention ("exemplary" as used herein referring to "serving as an example, instance or illustration"). The adjustable strap assembly 100 depicted in FIG. 1, includes a cincture 1102 and a band 1202. Depending on the application, either or both the cincture 1102 or the band 1202 may be fabricated using a sturdy elastic material, such as preferably a polyester webbing material, to allow sizes, such as the length, of the cincture 1102 or the band 1202 to expand and keep whatever is being secured is firmly retained. Of course only part or all of the cincture 1102 or the band 1202 may be made from a sturdy elastic material. FIGS. 2 and 3 illustrate a front view and a side view of the cincture 1102 of the adjustable strap assembly 100. FIGS. 4 and 5 illustrate a front view and a side view of the band 1202 of the adjustable strap assembly 100. The cincture 1102 may have a cincture adjusting end 1104 and a cincture fastening end 1106 (shown in FIGS. 1-3). The band 1202 may have a band adjusting end 1204 and a band fastening end 1206 (shown in FIGS. 1, 4 and 5).

Referring back to FIG. 1, the adjustable strap assembly 100 may comprise an adjustment mechanism 101. In one embodiment, the adjustment mechanism 101 may be configured to adjust the overall length of the adjustable strap assembly 100. The adjustment mechanism depicted in FIG. 1 holds the cincture and/or band in place in accordance with the desired overall length of the adjustable strap assembly 100. In FIG. 1, the adjustment mechanism 101 comprises a first sleeve 1108 configured to be attached to the cincture adjusting end 1104 and a second sleeve 1208 configured to be attached to the band adjusting end 1204. The first sleeve 1108 and the second sleeve 1208 may be attached to the cincture 1102 and the band 1202 by one of sewing, glue, adhesive or Velcro or other convenient method of securing.

The adjustable strap assembly 100 may also comprise a fastening mechanism configured to fasten the cincture fastening end 1106 and the band fastening end 1206. The fastening mechanism may comprise a first fastening element configured to be attached to the cincture fastening end 1106 and a second fastening element configured to be attached to the band fastening end 1206. One of the first and second fastening elements is held by the other in a secure manner. For example, the fastening mechanism may be a snap buckle, as shown in FIG. 1, including a male fastening element 1110 attached to the cincture fastening end 1106 and a female fastening element 1210 attached to the band fastening end 1206. The male fastening element 1110 may be held by the female fastening element 1210 in a secure manner. The fastening mechanism may comprise two clasps attached to the cincture and band fastening ends respectively. By holding one clasp in the other, the cincture and band fastening ends are snapped together and fastened. The fastening mechanism may also be in other forms according to various applications, such as a buckle, snap hook, S hook, popper, press stud, hook, Velcro cinch strap, fastener, carabiner, and/or other fastening mechanisms that can be configured to fasten two free ends to each other or a rack dolly or other carrier.

The adjusting mechanism 101 may comprise a securing mechanism 103 to secure the cincture 1102 relative to the band 1202 once the desired length of the adjustable strap assembly 100 has been set. In one embodiment, the securing mechanism 103 may comprise one or more securing elements (e.g., 1112 shown in FIG. 2, and 1212 shown in FIG. 4) attached to the cincture 1102 and the band 1202. Preferably a portion of the securing elements is attached to the cincture 1102 and another portion of the securing element is attached to the band 1202. In one example, the securing elements may comprise a male (e.g., 1112 shown in FIG. 2) and a female part (1212 shown in FIG. 4). The male part may include a projecting portion (e.g., 1112*a* shown in FIG. 3) and may be part of a snap, a press stud, a popper, an interlocking disc, a snap hook, an S hook, a button or Velcro hooks. The female part may be configured to receive the projecting portion and may be an interlocking disc, a hook hole, a button hole or Velcro loops. In another example, the securing elements may comprise two male parts. For example, the two male parts may each be a hook. In this regard, a hook on the cincture 1102 is coupled to a hook on the band 1202. In the embodiment illustrated in FIG. 1, the securing mechanism 103 comprises a plurality of securing elements. The securing elements include a male part in the form of a stud 1112 (shown in FIGS. 2 and 3) and a female part, such as a reinforced through hole 1212 (shown in FIG. 4) in the band 1202 into which the stud 1112 can be inserted. Depending on the application there may not be the same number of securing elements attached to the cincture 1102 as are attached to the band 1202. For example, there may be two or more reinforced through holes 1212 and only one stud 1112. The parts of the securing elements may be attached to or formed on the cincture 1102 and the band 1202 by glue, adhesive, staple, hammering, plying, sewing, drilling, reaming, milling, and/or any other suitable method or combination of methods.

In another embodiment, the adjusting mechanism may comprise a cam buckle, side release buckle, ladderloc adjustment buckle, snap hook, tri-glide, D-ring assembly, and/or any other suitable mechanisms that allows adjustment of the overall length of the adjustable strap assembly and can secure the cincture 1102 relative to the band 1202 to maintain the overall length of the adjustable strap assembly even when stressed and securing a bundle.

Figure 6:
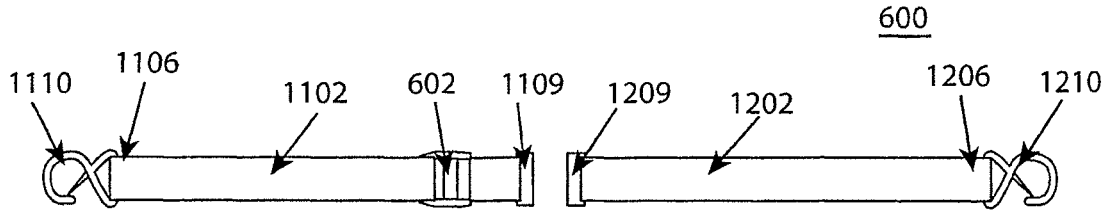
FIG. 6 illustrates a front view of exemplary components of an adjustable strap assembly in accordance with an exemplary embodiment.

FIG. 6 illustrates a front view of the cincture 1102 of an adjustable strap assembly 600 including a cam buckle 602 attached to the cincture 1102. D-rings 1109 and 1209 are attached to the adjusting ends of the cincture 1102 and band 1202, respectively to eliminate any loose hanging ends when the adjustable strap assembly 600 is adjusted to the desired length. The adjustable strap assembly 600 comprises a fastening mechanism that comprises a cincture hook 1110 and a band hook 1210. The cincture hook 1110 and the band hook 1210 are configured to be attached to their associated end (e.g., the cincture fastening end 1106 and the band fastening end 1206).

Figure 7:
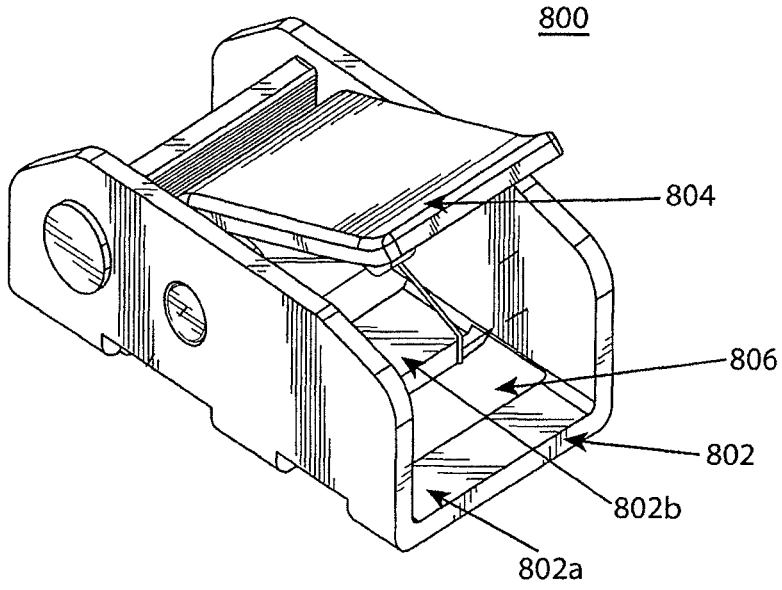
FIG. 7 illustrates an exemplary cam buckle.

FIG. 7 illustrates an exemplary cam buckle. With references to FIGS. 6-7, the cam buckle 800 may include a base member 802 and a lever member 804. The lever member 804 may include teeth, tab, thumb button, and/or any other types of projections that contact the cincture 1102 or band 1202 that holds the relative positions of the cincture 1102 and the band 1202 once the user has adjusted the adjustable strap assembly to a desired length. The cam buckle may be a toothless cam buckle and may include one or more bars to secure the band 1202. The base member may include two or more base elements and one opening between the two adjacent base elements. For example, the base member 802 may include a first base element 802*a* and a second base element 802*b*. An opening 806 shaped for insertion of the band 1202 may be formed between the first and second base elements (802*a*, 802*b*). The band 1202 may be inserted through the opening 806 and may be wrapped around one of the first base element and the second base element depending on the way of attaching the cam buckle onto the cincture 1102. At least a portion of one of the cincture 1102 and the band 1202 may be made from a sturdy elastic material to ensure constant tension when the adjustable strap assembly is securing a bundle.

Figure 8:
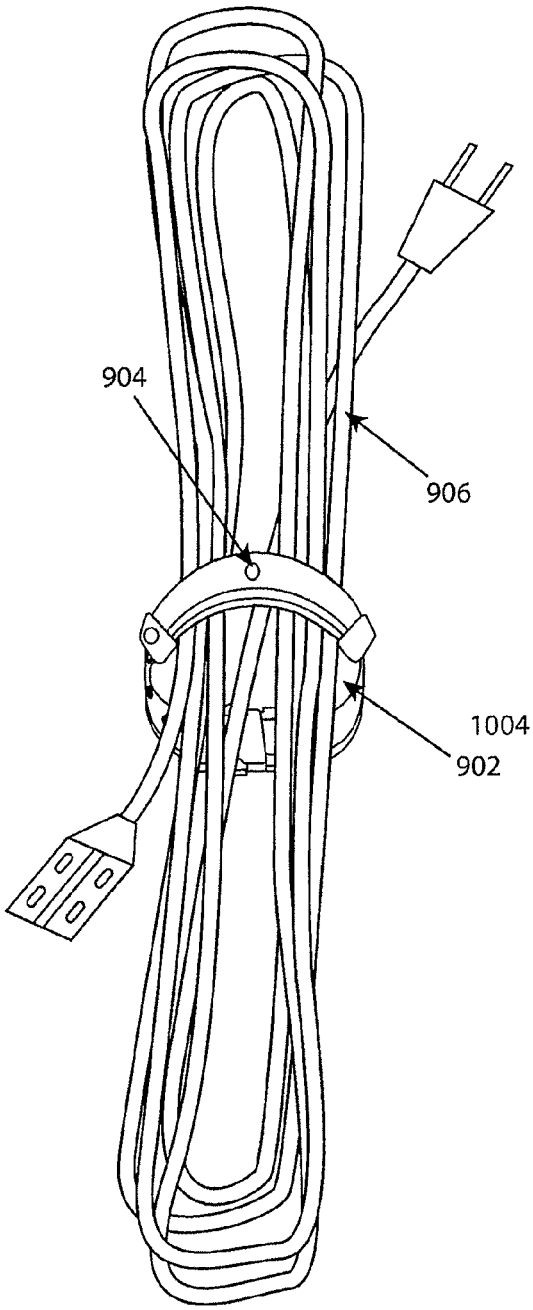
FIG. 8 illustrates a side view of a cinched adjustable strap assembly in accordance with an exemplary embodiment.
Figure 9:
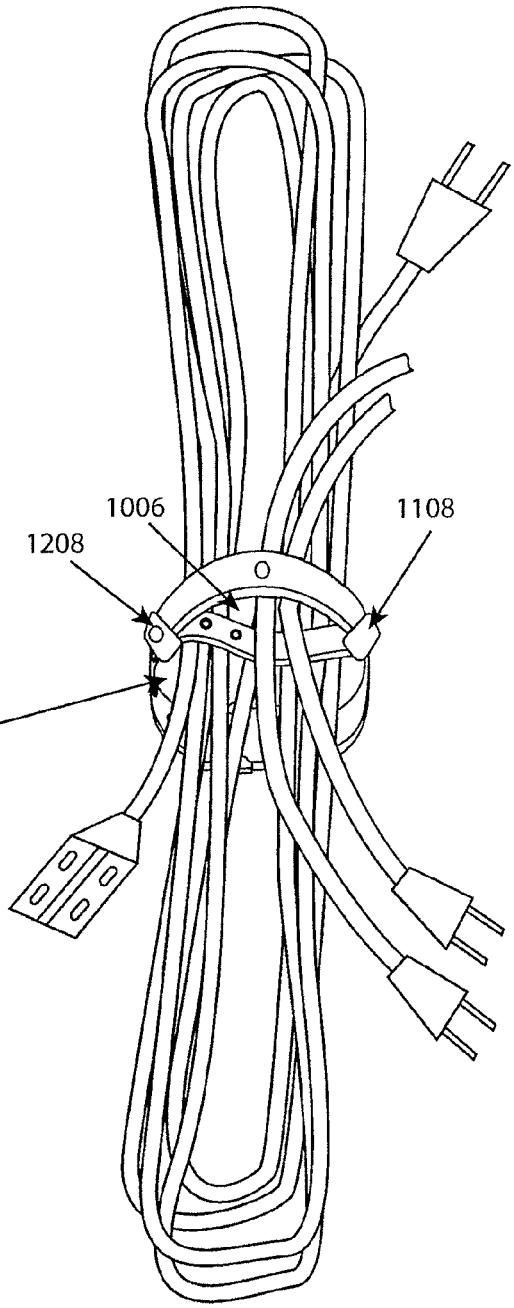
FIG. 9 illustrates a side view of a cinched adjustable strap assembly that allows cinching of two objects in accordance with an exemplary embodiment.

The exemplary adjustable strap assembly 100 may be used in different manners. One of the methods to use the strap assembly 100 is illustrated in FIGS. 8 and 9. With reference to FIGS. 1, 8 and 9, after the cincture 1102 is assembled with the band 1202, namely, the cincture 1102 extends through the second sleeve 1208 and the band 1202 extends through the first sleeve 1108, the length of the adjustable strap assembly 100 can be adjusted by pulling at least one of the cincture fastening end 1106 and the band fastening end 1206. In this embodiment, the length of the adjustable strap assembly 100 is adjusted by pulling one of the first fastening element 1110 and the second fastening element 1210, or pulling both of the first and second fastening elements (1110, 1210) in opposite directions.

When the cincture fastening end 1106 and the band fastening end 1206 is fastened by a fastening mechanism (e.g., the first fastening element 1110 and the second fastening element 1210 shown in FIG. 1), a first loop (e.g., a first loop 902 shown in FIG. 8) may be formed to allow an insertion of a first object 906. The first object can be a coil or an extension cord. To secure the cincture 1102 relative to the band 1202, one or more first securing elements may engage with one or more second securing elements. For example, as shown in FIG. 8, the first securing element 904 may engage with one of the second securing elements (not shown). In another embodiment, the adjustable strap assembly 100 may also be used to store an extension cord and free ends, i.e., the plugs, of the cord in separate spaces. As shown in FIG. 9, plugs of the extension cord may be placed in first loop 1004 and second loop 1006 separately.

Figure 11:
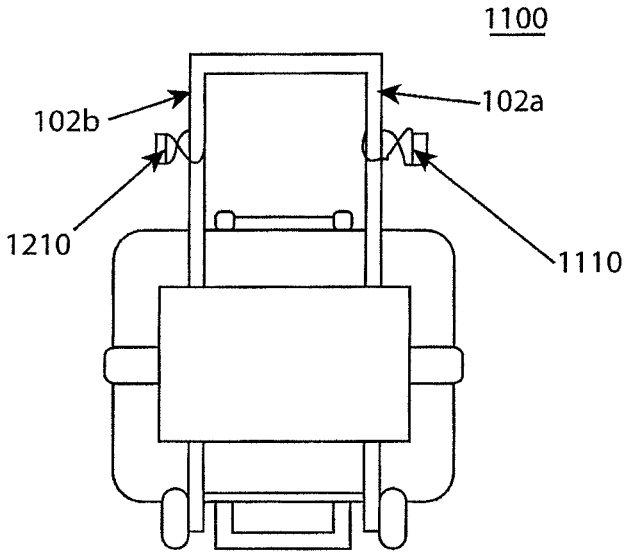
FIG. 11 illustrates a back view of an adjustable strap assembly hooked with racks.
Figure 12:
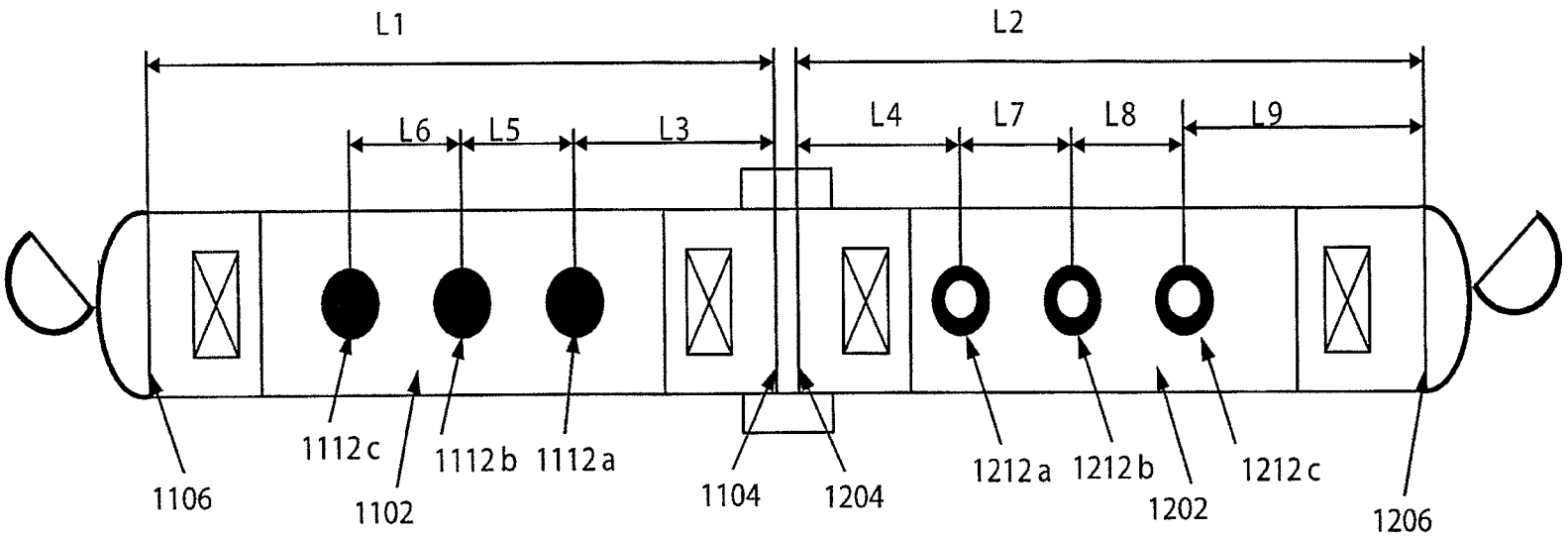
FIG. 12 illustrates dimensions of an adjustable strap assembly in accordance with an exemplary embodiment of the present invention.

In another embodiment, the fastening ends (e.g., the cincture fastening end 1106 and the band fastening end 1206 shown in FIG. 1) of the adjustable strap assembly 100 may not be fastened to each other. For example, the adjustable strap assembly 100 may be used to secure, a backpack 1102 (shown in FIG. 10) or a suitcase, a brief case, and/or a parcel, to a luggage rack 1104 to prevent it from falling down. In this regard, the adjustable strap assembly 100 may wrap around the backpack 1102. Each of the fastening elements (1110,

1210) is then hooked with one of the two handles (e.g., 102*a*, 102*b* as shown in FIG. 11) to secure the backpack.

The cincture 1102 and the band 1202 may be used in different manners with variance in assembling the cincture and band, securing mechanism, adjustment mechanism and fastening mechanism. For example, in an instance in which a cam buckle is used as the securing mechanism, the length of the strap assembly 100 may be adjusted by pulling one of the cincture and band fastening ends.

Figure 10:
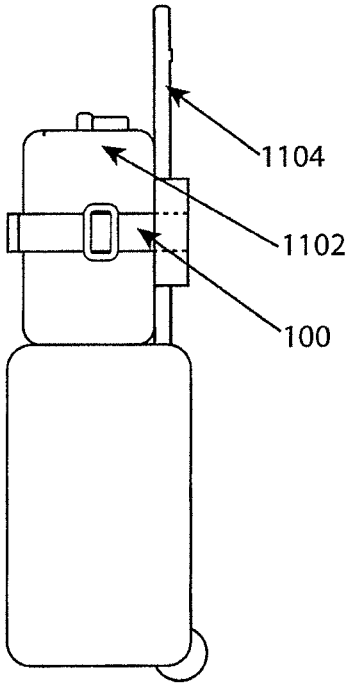
FIG. 10 illustrates side view of a backpack secured to a rack by an adjustable strap assembly in accordance with an exemplary embodiment.

FIG. 10 illustrates dimensions of an adjustable strap assembly in accordance with an exemplary embodiment of the present invention. The length of the cincture 1102 may range from being substantially the same length as that of the band 1202 to many times as long as the band or vice versa. For example, the length of the cincture 1102 (L1) may be the same as that of the band 1202 (L2). In one example, L1 and L2 may be about 13.75 inches. As discussed above, the cincture 1102 may have one or more first securing elements (e.g., 1112*a*, 1112*b*, 1112*c*). The one or more first securing elements 1112 may be aligned with each other. The band 1202 may have one or more second securing elements (e.g., 1212*a*, 1212*b*, 1212*c*). The number and spacing of first and second securing elements will depend on the application and whether the length of the adjustable strap assembly is a gross or fine adjustment. Similar to the first securing elements, the one or more second securing elements may be aligned with each other. Also the spacing of the securing elements attached to cincture 1102 may have different spacing than the securing elements attached to the band 1202 and may not be equally spaced. In one embodiment, one of the second securing elements may be engaged with one of the first securing elements to secure the cincture 1102 relative to the band 1202. The placement and the number of the first securing elements on the cincture 1102 may be similar to those of the second securing elements on the band 1202. For example, the shortest distance (e.g., L3) between the first securing element (e.g., the first securing element 1112*a*) and the cincture adjusting end 1104 may have the same length as the shortest distance (e.g., L4) between the second securing element (e.g., the second securing element 1212*a*) and the band adjusting end 1204. In one example, the length of L3 and L4 may be about 1.25 inches. Distance between adjacent first securing elements may be the same. For example, distance (e.g., L5) between the first securing elements 1112*a* and 1112*b* may have the same length as distance (e.g., L6) between the first securing elements 1112*b* and 1112*c*. In one example, L5 and L6 may be about 1 inch. Similarly, distance between adjacent second securing elements such as distance L7 between the second securing element 1212*a* and 1212*b*, and distance L8 between the second securing element 1212*b* and 1212*c* may have the same length. In one example, L7 and L8 may be about 1 inch. The shortest distance between the second securing element 1212*c* and the band fastening end 1206 may have length of L10. In one example, the length may be about 2.5 inch.

It should be understood that the placement of the first and second securing elements, distance between adjacent first and adjacent second securing elements, distance between the second securing elements and the band fastening end 1206 may not be limited to the examples described above. The first and second securing elements may be placed in different patterns. Length of distance between adjacent securing elements may vary according to various applications and usages.

Many modifications and other example embodiments set forth herein will come to mind to the reader knowledgeable in the technical field to which these example embodiments pertain to having the benefit of the teachings presented in the foregoing descriptions and the associated drawings. Therefore, it is to be understood that the embodiments are not to be limited to the specific ones disclosed and that modifications and other embodiments are intended to be included within the scope of the claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions other than those explicitly described above are also contemplated as may be set forth in some of the appended claims.

That which is claimed:

1. An adjustable strap assembly, comprising:

a cincture having a cincture adjusting end and a cincture fastening end;

a cincture securing device attached to the cincture adjusting end;

a band having a band adjusting end and a band fastening end;

a band securing device attached to the band adjusting end;

an adjustment mechanism configured to adjust the overall length of the adjustable strap assembly to a desired length and hold the cincture and/or band in place in accordance with the desired length of the adjustable strap assembly;

the cincture securing device and the band securing device are configured to eliminate any loose hanging ends of the cincture and the band when the adjustable strap is adjusted to said desired length; and a fastening mechanism attached to the cincture fastening end and the band fastening end, wherein at least a portion of one of the cincture and the band is comprised of a sturdy elastic material.

2. The adjustable strap assembly of claim 1, wherein the adjusting mechanism comprises one of a cam buckle, side release buckle, ladderloc adjustment buckle, snap hook, triglide and D-ring.

3. The adjustable strap assembly of claim 1, wherein the adjusting mechanism comprises a first sleeve through which the cincture extends and a second sleeve through which the band extends.

4. The adjustable strap assembly of claim 3, wherein at least one of the first sleeve and the second sleeve comprises at least one of a ring, a strap loop, a buckle, hook and loop fastener cinch strap, clasp and carabiner.

5. The adjustable strap assembly of claim 3, wherein one of the first sleeve and the second sleeve is attached to the associated adjusting end by one of sewing, glue, adhesive and hook and loop fastener.

6. The adjustable strap assembly of claim 3, wherein a second loop is formed by extending the cincture through the first sleeve and extending the band through the second sleeve to allow an insertion of a second object.

7. The adjustable strap assembly of claim 1, wherein the size of the adjustable strap assembly is adjusted by pulling at least one of the cincture fastening end, the band fastening end, the cincture adjusting end and the band adjusting end.

8. The adjustable strap assembly of claim 1, wherein the fastening mechanism comprises one of buckle, clasp, snap hook, S hook, popper, press stud, hook, hook and loop fastener cinch strap, clasp, fastener and carabiner.

9. The adjustable strap assembly of claim 1, wherein the fastening mechanism comprises a first fastening element configured to be attached to the cincture fastening end and a second fastening element configured to be attached to the band fastening end, and wherein one of the first and second fastening elements is held by the other in a secure manner.

10. The adjustable strap assembly of claim 1, further comprising a securing mechanism configured to secure the cincture relative to the band once the desired size of the adjustable strap assembly has been set.

11. The adjustable strap assembly of claim 10, wherein the securing mechanism comprises a male part and a female part.

12. The adjustable strap assembly of claim 10, wherein the securing mechanism comprises one or more first securing elements configured to be attached to the cincture, and one or more second securing elements configured to be attached to the band, and wherein the one or more first securing elements are configured to connect to the one or more second securing elements to secure the position of the cincture relative to the band.

13. The adjustable strap assembly of claim 12, wherein one of the first and second securing elements comprises at least one of hook, snap, press stud, popper, button, hook and loop fastener hook, snap hook, S hook interlocking disc and rivet.

14. The adjustable strap assembly of claim 12, wherein one of first and second securing elements comprises at least one of hook hole, button hole, hook and loop fastener loops and interlocking disc.

15. The adjustable strap assembly of claim 12, wherein one of the first and second securing elements are attached to or formed on one of the male and bands by one of glue, adhesive, staple, hammering, plying, drilling, reaming, milling and sewing.

16. The adjustable strap assembly of claim 10, wherein the securing mechanism is attached to one of the cincture and band by one of glue, adhesive, staple, hammering, plying, sewing, drilling, reaming and milling.

17. The adjustable strap assembly of claim 1, wherein the adjustment mechanism includes a first sleeve attached to the cincture adjusting end and a second sleeve attached to the band adjusting end; the cincture and the band are configured such that the second sleeve slideably engages the cincture and the first sleeve slideably engages the band;

a fastening mechanism attached to the cincture fastening end and the band fastening end.

18. The adjustable strap assembly of claim 17, wherein the adjusting mechanism comprises a cam buckle fixedly attached to the cincture and slideably attached to the band such that the cam buckle can secure the relative positions of the cincture and the band to one another.

19. The adjustable strap assembly of claim 17, wherein the first and second sleeves are D-rings.

20. The adjustable strap assembly of claim 17, wherein the band comprises a sturdy elastic material.

21. The adjustable strap assembly of claim 1, wherein at least a portion of both the cincture and the band are comprised of a sturdy elastic material.

22. The adjustable strap assembly of claim 1, wherein the fastening mechanism comprises a first fastening element configured to be attached to the cincture fastening end and a second fastening element configured to be attached to the band fastening end, wherein the first fastening element is configured to be connected to the second fastening element, and the second fastening element is configured to be connected to the first fastening element.

* * * * *